US006966483B2

(12) United States Patent
Manninen

(10) Patent No.: US 6,966,483 B2
(45) Date of Patent: Nov. 22, 2005

(54) PIZZA BOX APPARATUS

(76) Inventor: Michael W. Manninen, 6501 Red Hook Plz., Ste. 201, St. Thomas, VI (US) 00802

( * ) Notice: Subject to any disclaimer, the term of this patent is extended or adjusted under 35 U.S.C. 154(b) by 0 days.

(21) Appl. No.: 10/420,459

(22) Filed: Apr. 22, 2003

(65) Prior Publication Data

US 2003/0201316 A1 Oct. 30, 2003

Related U.S. Application Data

(60) Provisional application No. 60/374,687, filed on Apr. 24, 2002.

(51) Int. Cl.[7] ..... B65D 5/00

(52) U.S. Cl. ..... 229/103; 229/115; 229/904; 229/906

(58) Field of Search ..... 229/103, 115, 229/906, 904

(56) References Cited

U.S. PATENT DOCUMENTS 3,310,220 A 3/1967 Feldman
4,452,367 A 6/1984 Wein
4,535,928 A * 8/1985 Capo ..... 229/103
5,014,853 A * 5/1991 Crockett ..... 229/103
D319,259 S * 8/1991 Weir ..... D19/1
5,071,062 A * 12/1991 Bradley et al. ..... 229/109
5,110,038 A 5/1992 Pantisano et al.
5,476,214 A 12/1995 Fisk, Jr.
5,601,230 A * 2/1997 Bell ..... 229/103
6,375,066 B1 * 4/2002 Ritter ..... 229/101.2
6,440,050 B1 * 8/2002 Capparelli et al. ..... 493/59
6,585,551 B2 * 7/2003 McClung et al. ..... 446/46

* cited by examiner

*Primary Examiner*—Tri M. Mai

(57) ABSTRACT

A relatively large food container includes a food box member in combination with a removable relatively small unfolded food container blank or insert. More specifically, the food box member includes an outside box member portion, the unfolded food container blank or insert is in a form of an inside box member portion, and perforations or slit cuts connect the outside box member portion to the inside box member portion. The removable unfolded food container blank is shaped and has fold lines so that when suitably manipulated it is adapted to form a triangularly-shaped small food box. The triangularly-shaped small food box is eminently suitable for storing left-over triangularly-shaped pieces or "wedges" of pizza.

3 Claims, 5 Drawing Sheets

FIG 3
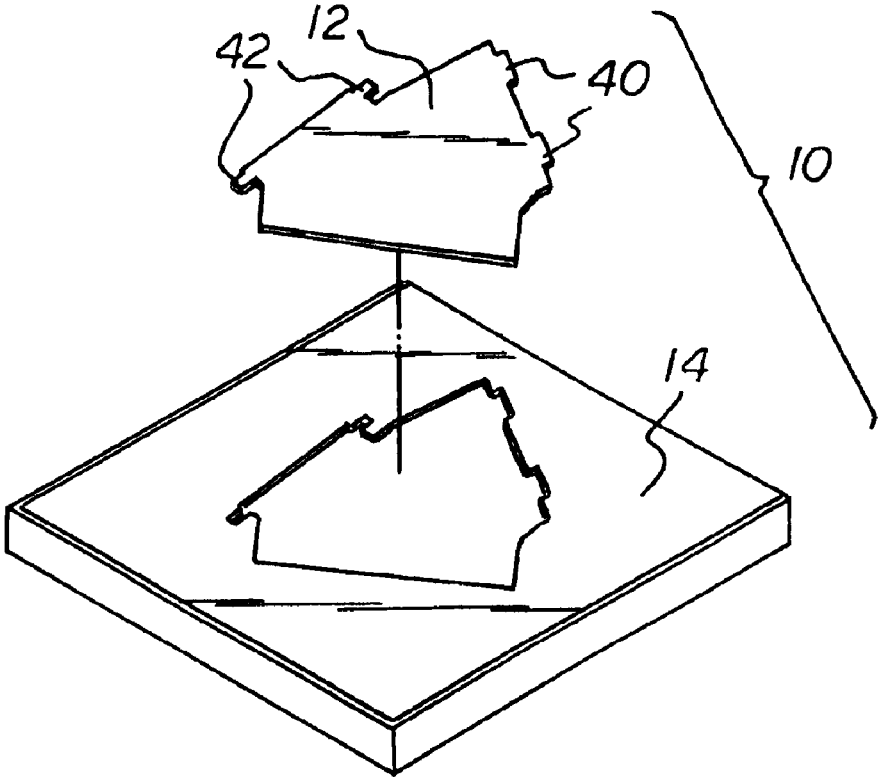
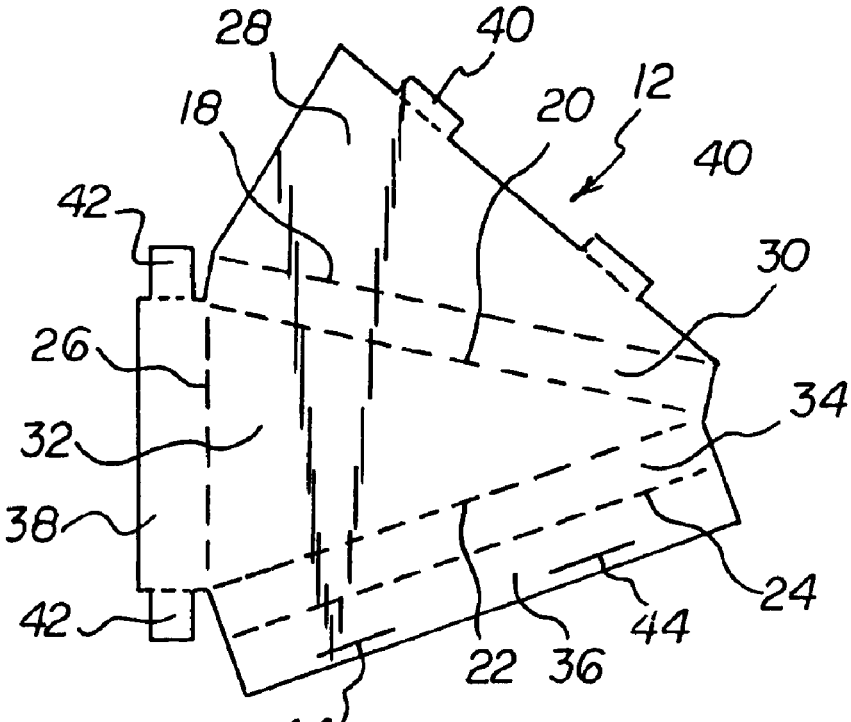
FIG 4

PIZZA BOX APPARATUS

CROSS-REFERENCE TO RELATED APPLICATION

This application claims priority based upon my copending Provisional Application Ser. No. 60/374,687; filed Apr. 24, 2002.

BACKGROUND OF THE INVENTION

1. Field of the Invention

The present invention relates generally to boxes for food products and, more particularly, to boxes especially adapted for retaining leftovers from a pizza.

2. Description of the Prior Art

A pizza is often delivered in a box. Although a pizza may be circular in shape, a pizza box is generally rectangular in shape. Circular pizzas are generally cut up into triangular-shaped, individual serving size pieces which are considerably smaller than the overall circular pizza. Often, after a meal, one or more triangular-shaped pizza pieces remain as leftovers. The box used for delivery of the original circular pizza is relatively large, and a leftover triangular-shaped piece of pizza is relatively small. Therefore, if the original pizza box is used for storing a triangular-shaped piece of leftover pizza in a refrigerator, a great deal of refrigerator space is wasted to accommodate the original pizza box. To avoid such waste of refrigerator space, it would be desirable if a relatively large pizza delivery box could be adapted to become a relatively small box for storing a triangular-shaped piece of leftover pizza.

Throughout the years, a number of innovations have been developed relating to converting a relatively large box to a relatively small box after part of the contents of the relatively large box is removed therefrom. In this respect, U.S. Pat. No. 3,310,220 discloses a reducible cardboard container that is reducible in size as part of its contents is removed and that retains its general shape and configuration as its size is reduced. The form of the large box size in rectangular, and the form of the small box size is rectangular. Since a piece of leftover pizza is often triangular-shaped, it would be desirable if a relatively large rectangular box could be adapted to provide a relatively small triangular-shaped box for triangular-shaped pizza leftover. U.S. Pat. Nos. 5,071,062, 5,110,038, and 5,476,214.

U.S. Pat. No. 4,452,367 discloses another variable size box construction. A relatively small box, about one-half size, can be formed from a relatively large box. Both the relatively large box and the relatively small box are rectangular in shape.

U.S. Pat. No. 5,071,062 discloses a reducible carton for pizza pies and the like. The form of the large box size in rectangular, and the form of the small box size is rectangular. Moreover, it is pointed out the entire large box is folded into a smaller form. To provide a smaller box that includes less material than the larger box would be desirable so that the smaller box will be less insulated for cooling the leftover pizza that is placed in the refrigerator.

U.S. Pat. No. 5,110,038 discloses plate forming and break down pizza box. Portions of the box are perforated, and the perforated portions are circular-shaped to form round plates. Similarly, U.S. Pat. No. 5,476,214 discloses another plate forming and break down pizza box. Portions of the box are perforated, and the perforated portions are triangular-shaped to form triangular-shaped plates for receiving triangular-shaped pieces of pizza. Generally, these patents teach the use of perforated portions of a relatively large box to provide smaller plates. Rather than providing plates, it would be desirable if perforated portions of a relatively large box would provide a blank for a relatively small box.

Thus, while the foregoing body of prior art indicates it to be well known to provide a relatively small box from a relatively large box, the prior art described above does not teach or suggest a pizza box apparatus which has the following combination of desirable features: (1) provides that a relatively large pizza delivery box can be adapted to become a relatively small box for storing a triangular-shaped piece of leftover pizza; (2) provides that a relatively large rectangular box can be adapted to provide a relatively small triangular-shaped box for triangular-shaped pizza leftover; (3) provides a smaller box from a larger box that includes less material than the larger box; and (4) includes perforated portions in a relatively large box that provide a blank for a relatively small box. The foregoing desired characteristics are provided by the unique pizza box apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a food storage apparatus which includes a relatively small unfolded food container blank in combination with a relatively large food container. Preferably, the relatively large food container includes a food box member, and the relatively small unfolded food container comprises a blank or insert removably supported by the food box member.

More specifically, the food box member includes an outside box member portion, the unfolded food container blank or insert is in a form of an inside box member portion, and conventional perforations, slit cuts or the like removably connect or otherwise removably join the outside box member portion to the inside box member portion. Preferably, the unfolded food container blank is shaped and has fold lines so that when suitably manipulated after removal the unfolded food container blank or insert forms a triangularly-shaped small food box when folded along the fold lines. The triangularly-shaped small food box is eminently suitable for storing left-over triangularly-shaped pieces of pizza.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pizza box apparatus which has all of the advantages of the prior art and none of the disadvantages.

It is another object of the present invention to provide a new and improved pizza box apparatus which may be easily and efficiently manufactured and marketed.

It is a further object of the present invention to provide a new and improved pizza box apparatus which is of durable and reliable construction.

An even further object of the present invention is to provide a new and improved pizza box apparatus which is susceptible of a low cost of manufacture with regard to both materials and labor, and which accordingly is then susceptible of low prices of sale to the consuming public, thereby making such pizza box apparatus available to the buying public.

Still yet a further object of the present invention is to provide a new and improved pizza box apparatus which provides that a relatively large pizza delivery box can be adapted to become a relatively small box for storing a triangular-shaped piece of leftover pizza.

Still another object of the present invention is to provide a new and improved pizza box apparatus that provides a relatively large rectangular box that can be adapted to provide a relatively small triangular-shaped box for triangular-shaped pizza leftovers.

Yet another object of the present invention is to provide a new and improved pizza box apparatus which provides a smaller box from a larger box that includes less material than the larger box.

Even another object of the present invention is to provide a new and improved pizza box apparatus that includes perforated portions in a relatively large box that provide a blank or insert for a relatively small box.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a top exploded perspective view of the large box lid shown in FIG. 1 wherein the inside box member portion is separated from the outside box member portion.

FIG. 4 is an enlarged top plan view of the inside box member portion of the embodiment of the invention shown in FIG. 3.

DESCRIPTION OF THE PREFERRED EMBODIMENT

Figure 1:
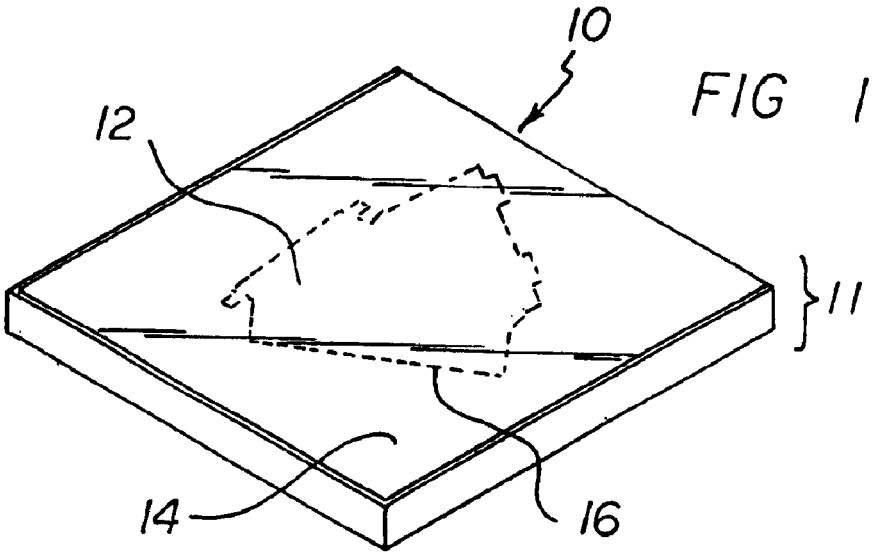
FIG. 1 is a top perspective view showing a preferred embodiment of the pizza box apparatus of the invention wherein an inside box member portion is retained in an outside box member portion, and the two box member portions are part of a large box lid.

With reference to the drawings, a new and improved pizza box apparatus embodying the principles and concepts of the present invention will be described.

Turning to FIGS. 1–5, there is shown an exemplary embodiment of the pizza box apparatus of the invention generally designated by reference numeral 10. In its preferred form, a food storage apparatus includes a relatively small unfolded food container blank 12 in combination with a relatively large food container. Preferably, the relatively large food container includes a food box member 10, and the relatively small unfolded food container blank 12 is supported by or otherwise attached to the food box member 10.

More specifically, the food box member 10 includes an outside box member portion 14, the unfolded food container blank 12 is in a form of an inside box member portion 12, and perforations or slit cuts 16 removably connect or otherwise attach the outside box member portion 14 to the inside box member portion 12 in a manner well understood in the box manufacturing art.

Preferably, in accordance with the invention, the unfolded food container blank or insert 12 is shaped and has fold lines so that when suitably manipulated (i.e. folded) the food container blank or insert 12 forms a triangularly-shaped or wedge-shaped small food box. The triangularly-shaped small food box is especially suitable for storing left-over triangular slices or "wedges" of the complete pizza pie originally delivered in the food box member 10, following initial use of the food box member 10. In this regard, the outside box member portion 14 may be disposed of and the small or wedge-shaped food box according to the invention may conveniently be stored in a refrigerator, picnic basket, cooler, or elsewhere, until later use.

Preferably, the unfolded food container blank or insert 12 includes small box panels and fold lines between the small box panels. The small box panels includes one or more lock tabs for reclosably locking the food container blank 12 into a small food box when the small box panels are folded along the fold lines.

More specifically, the unfolded food container blank or insert 12 includes a first small box panel 28, a second small box panel 30, and a first-to-second panel fold line 18 between the first small box panel 28 and the second small box panel 30. A third small box panel 32 is provided, and a second-to-third panel fold line 20 is between the second small box panel 30 and the third small box panel 32. A fourth small box panel 34 is provided, and a third-to-fourth panel fold line 22 is between the third small box panel 32 and the fourth small box panel 34. A fifth small box panel 36 is provided, and a fourth-to-fifth panel fold line 24 is between the fourth small box panel 34 and the fifth small box panel 36. A sixth small box panel 38 is provided, and a third-to-six panel fold line 26 is between the third small box panel 32 and the sixth small box panel 38.

The sixth small box panel 38 includes sixth panel lock tabs 42, the first small box panel 28 includes first panel lock tabs 40, and the fifth small box panel 36 includes fifth panel lock tab reception slots 44 for receiving the first panel lock tabs 40. Preferably, the first small box panel 28 and the third small box panel 32 are triangularly-shaped. The second small box panel 30, the fourth small box panel 34, and the sixth small box panel 38 are rectangularly-shaped.

The unfolded food container blank 12 can be located in a top portion of a relatively large food box. In addition, the unfolded food container blank or insert 12 can be located in a bottom portion of the relatively large food box. If desired, a first unfolded food container blank 12 can be located in the top portion, and a second unfolded food container blank 12 can be located in the bottom portion of the relatively large food box.

If desired, an unfolded food container blank or insert 12 can be located in an insert that is placed inside a relatively large food box. Still alternatively, an unfolded food container blank 12 can be placed inside a relatively large food box. The size of the unfolded food container blank 12 can be varied, depending upon the quantity of food that is to be stored inside it when the unfolded food container blank 12 is folded into a small food box.

Figure 2:
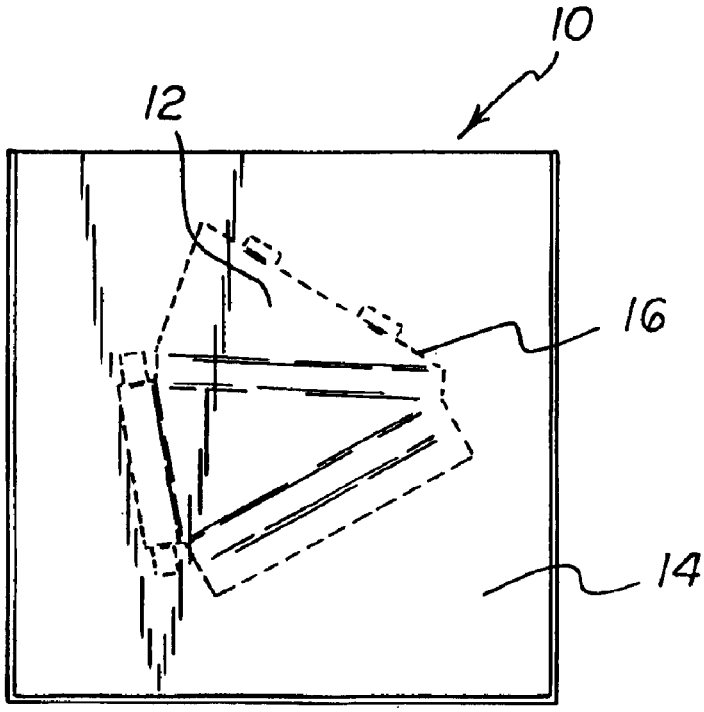
FIG. 2 is a top plan view of the embodiment of the pizza box apparatus shown in FIG. 1.
Figure 5:
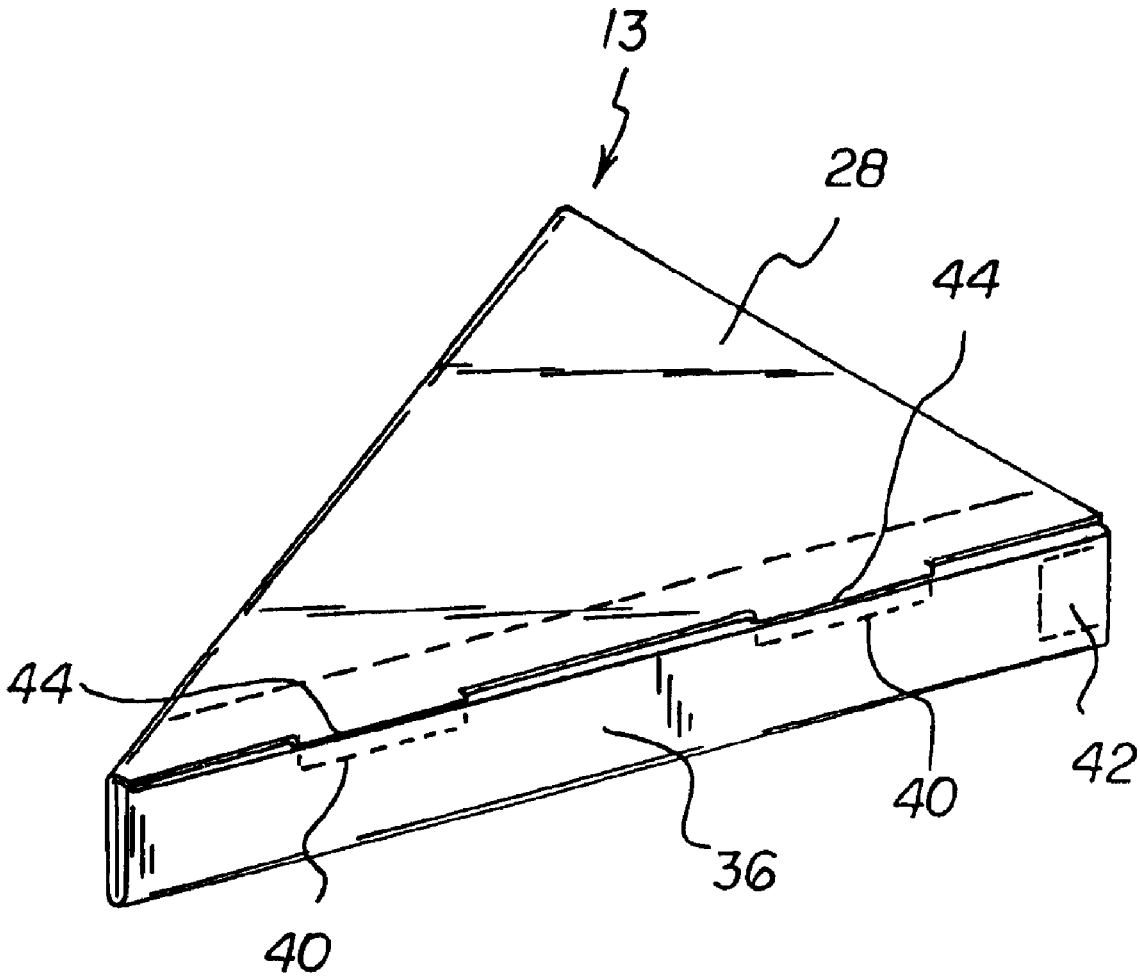
FIG. 5 is a perspective view of the embodiment of the inside box member portion of FIG. 4 folded and locked into a small food box.

To use the large box 11 of the invention shown in FIGS. 1–3, a food item, such as a pizza pie (not shown), is transported in the large box 11 in a manner well known in the art. To access the pizza, the large food box member 10, which is in the form of the lid of the large box 11, is lifted up, and pieces of pizza are taken out of the large box 11. When there is a piece or pieces of triangularly-shaped pizza that is/are left over, instead of using the large, space-consuming large box 11 to store such a piece or pieces of triangularly-shaped pizza, aluminum foil or the like, the left over pizza pie slices or "wedges" can advantageously be stored in the folded-up triangularly-shaped or wedge-shaped box 13 shown in FIG. 5.

More specifically, the unfolded food container blank 12 is separated from the outside box member portion 14 by tearing out the unfolded food container blank 12 along the perforations or cut-slits 16 in the food box member 10. Once the unfolded food container blank 12 has been separated from the food box member 10, the unfolded food container blank 12 can be folded along the fold lines to arrive at the folded-up triangularly-shaped box 13.

More specifically, the first small box panel 28 is swung along the first-to-second panel fold line 18 towards the second small box panel 30. The second small box panel 30 is swung towards the third small box panel 32 along the second-to-third panel fold line 20. The sixth small box panel 38 is swung toward the third small box panel 32 along the third-to-six panel fold line 26. The fourth small box panel 34 is swung toward the third small box panel 32 along the third-to-fourth panel fold line 22. One of the sixth panel lock tabs 42 is swung around the sixth small box panel 38 to rest against the outside of the second small box panel 30, and the other of the sixth panel lock tabs 42 is swung around the sixth small box panel 38 to rest against the outside of the fourth small box panel 34. Then, the fifth small box panel 36 is swung downward along the fourth-to-fifth panel fold line 24 to sandwich the second of the sixth panel lock tabs 42 between the fourth small box panel 34 and the fifth small box panel 36.

At this stage of folding, a triangularly-shaped box 13 is provided in which the first small box panel 28 serves as a lid which can be opened or closed around the first-to-second panel fold line 18 which serves as a hinge for the lid. A piece (or pieces) of triangularly-shaped pizza (i.e. a "wedge" of pizza) can be placed inside the folded-up triangularly-shaped box 13, with its lid open. Once the pizza wedge has been placed inside the folded-up triangularly-shaped box 13, the first small box panel 28, now lid 28 of a small food box, can be closed around the first-to-second panel fold line 18, now hinge 18. To keep the folded-up triangularly-shaped box 13 in a closed position, the first panel lock tabs 40 are slid into the fifth panel lock tab reception slots 44. When this is done, a closed small food box is obtained with the triangular-shaped piece or pieces of pizza stored inside. The food container blank 12 can include advertising and can include instructions for heating the pizza. The food container blank 12 can be varied in size include more or less storage capacity.

Optionally, the food container blank can be varied in shape to store a pizza slice that is not wedge-shaped. For example, if desired, it is within the contemplation of the present invention to provide a square or rectangular shaped food container blank or insert 12 for storing similar-shaped pizza slices following initial use of the original food container of which the food container blank is associated.

Figure 6:
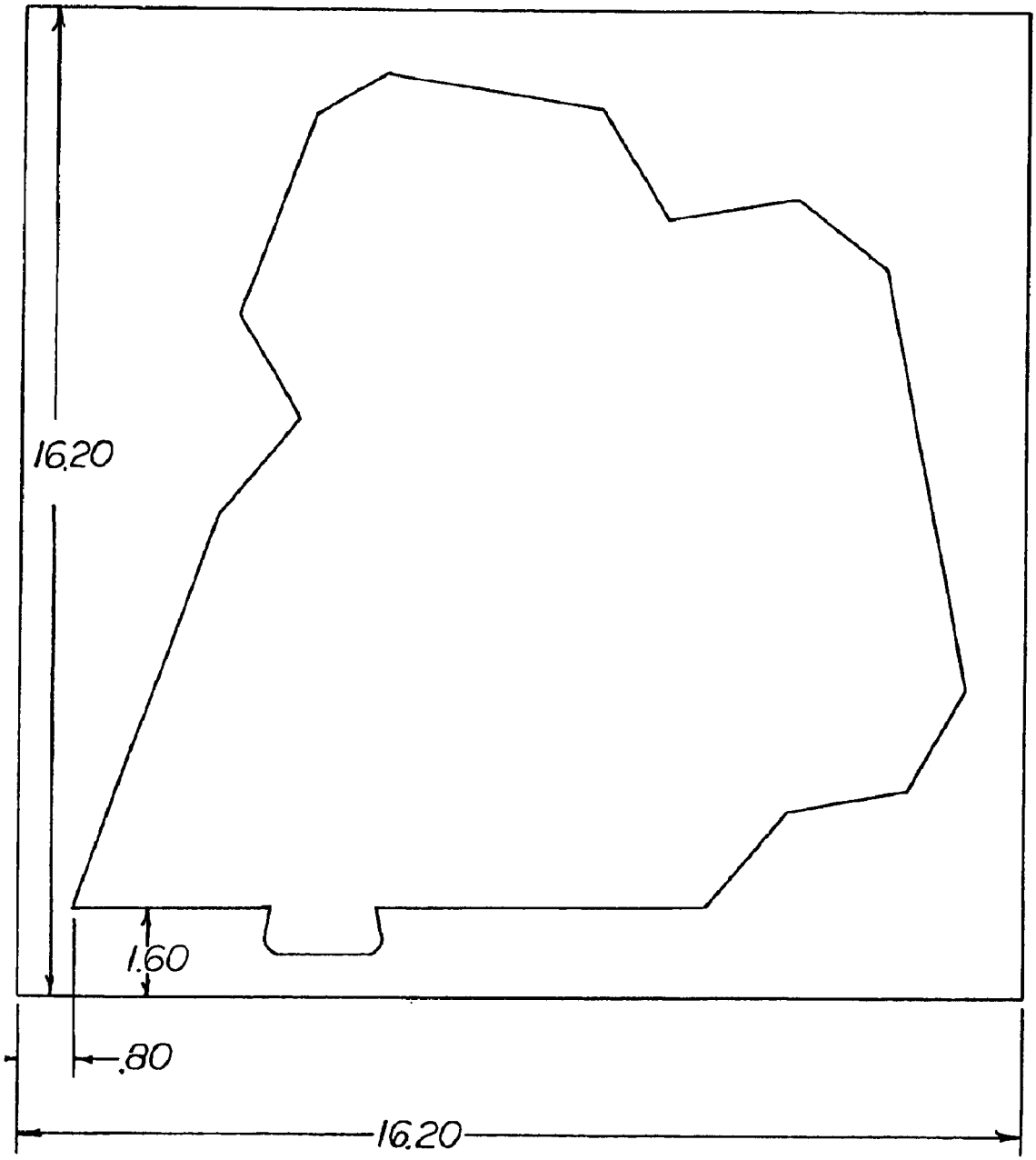
FIG. 6 is top plan view of an alternative mostly preferred embodiment of the pizza box apparatus of the invention giving the dimensions thereof.
Figure 7:
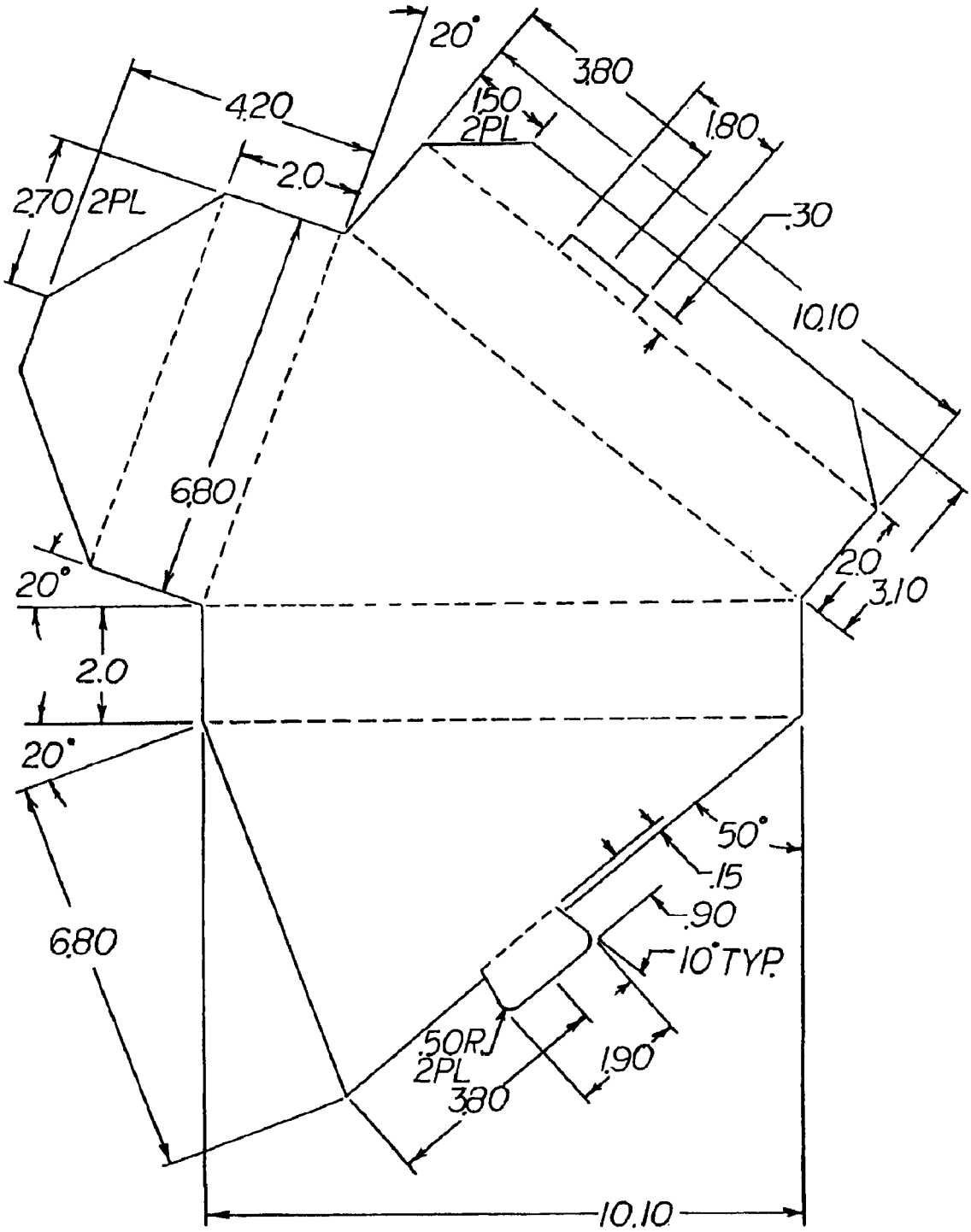
FIG. 7 is a top plan view of the inside box member portion of the embodiment of the invention shown in FIG. 6 giving the dimensions thereof.

To further illustrate the present invention without limiting same, FIG. 6 is top plan view of an alternative mostly preferred embodiment of the pizza box apparatus of the invention giving the dimensions thereof whereas FIG. 7 is a top plan view of the inside box member portion of the embodiment of the invention shown in FIG. 6 giving the dimensions thereof.

It will be appreciated that the alternatively mostly preferred embodiment of FIGS. 6 and 7 generally is similar to the prior embodiment, but is refined somewhat for manufacturing and cost efficiency and consumer use in the following respects: the lock tabs 42 are eliminated, an auxiliary or seventh outer panel is provided on the sixth panel (defined by a sixth-to-seventh fold line), and only one first panel lock tab 40 is employed for slidable engagement with one fifth panel lock tab reception slot 44, all substantially as illustrated. The foregoing represents just some of the wide range of refinements of the which the present invention is susceptible without departing from the spirit and principles thereof.

The components of the pizza box apparatus of the invention can be made from inexpensive and durable paper, cardboard, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved pizza box apparatus that is low in cost, relatively simple in design and operation, and which may advantageously be used to provide a relatively large pizza delivery box that can be adapted to become a relatively small box for storing a triangular-shaped piece of leftover pizza. With the invention, a pizza box apparatus provides that a relatively large rectangular box can be adapted to provide a relatively small triangular-shaped box for triangular-shaped pizza leftover. With the invention, a pizza box apparatus provides a smaller box from a larger box that includes less material than the larger box. With the invention, a pizza box apparatus is provided which includes perforated portions in a relatively large box that provide a blank for a relatively small box.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U. S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A food storage apparatus, comprising:

a relatively small unfolded food container blank in combination with a relatively large food container, wherein said unfolded food container blank includes:

a first small box panel, a second small box panel, a first-to-second panel fold line between said first small box panel and said second small box panel, a third small box panel, a second-to-third panel fold line between said second small box panel and said third small box panel, a fourth small box panel, a third-to-fourth panel fold line between said third small box panel and said fourth small box panel, a fifth small box panel, a fourth-to-fifth panel fold line between said fourth small box panel and said fifth small box panel, a sixth small box panel, and a third-to-six panel fold line between said third small box panel and said sixth small box panel, wherein:

said sixth small box panel includes sixth panel lock tabs, said first small box panel includes first panel lock tabs, and said fifth small box panel includes fifth panel lock tab reception slots for receiving said first panel lock tabs.

2. The apparatus of claim 1 wherein said first small box panel and said third small box panel are triangularly-shaped.

3. The apparatus of claim 1 wherein said second small box panel, said fourth small box panel, and said sixth small box panel are rectangularly-shaped.

* * * * *